United States Patent [19]

Hoffmann et al.

[11] 4,102,507

[45] Jul. 25, 1978

[54] FORMATION OF RESERVE WINDING FOR FURTHER CONNECTION ON BOBBINS OF TEXTILE MACHINES

[75] Inventors: Herbert Hoffmann, Bremen; Friedrich Wachendorf, Eggestedt, both of Germany Germany

[73] Assignee: Fried. Krupp Gesellschaft mit beschrankter Haftung, Essen, Germany

[21] Appl. No.: 723,493

[22] Filed: Sep. 15, 1976

[30] Foreign Application Priority Data

Sep. 19, 1975 [DE] Fed. Rep. of Germany ..... 2541761

[51] Int. Cl.[2] ..... B65H 54/02

[52] U.S. Cl. ..... 242/18 PW

[58] Field of Search ..... 242/18 PW, 18 A

[56] References Cited

U.S. PATENT DOCUMENTS

| | | | |
|---|---|---|---|
| 2,998,202 | 8/1961 | Keith et al. | 242/18 PW |
| 3,559,903 | 2/1971 | McDermott | 242/18 PW |
| 3,741,488 | 6/1973 | Wuest | 242/18 PW |
| 3,791,126 | 2/1974 | Kose et al. | 242/18 A X |
| 3,948,452 | 4/1976 | Burysek | 242/18 PW |
| 3,952,959 | 4/1976 | Shaw et al. | 242/18 PW |
| 3,964,722 | 6/1976 | Boggs et al. | 242/18 PW |

*Primary Examiner*—Harvey C. Hornsby
*Assistant Examiner*—John M. Jillions
*Attorney, Agent, or Firm*—Spencer & Kaye

[57] ABSTRACT

In a method for winding yarn on a yarn winding region of a bobbin in a textile machine having a yarn supply device delivering yarn to the bobbin, which method includes after severing of the yarn between a full bobbin and the yarn supply device, drawing off by means of a suction device, the yarn which continues to be delivered by the yarn supply device, and, at the commencement of winding a bobbin, the yarn coming from the yarn supply device is engaged by a hook-shaped catch element which rotates with the bobbin, a tie on reserve winding is formed from the yarn downstream of the catch element by positioning the suction device so as to bring the yarn leaving the yarn supply device to a position where it intersects the plane of rotation of the catch element at the diameter at which the catch element is located and, immediately after the yarn is caught by the catch element, bringing the yarn subsequently coming from the yarn supply device into the winding region and simultaneously extracting the yarn downstream of the catch element from the suction device and winding it on the bobbin adjacent the winding region to form a reserve winding.

12 Claims, 11 Drawing Figures

FORMATION OF RESERVE WINDING FOR FURTHER CONNECTION ON BOBBINS OF TEXTILE MACHINES

BACKGROUND OF THE INVENTION

The present invention relates to the formation of a reserve winding for further connection on the bobbins of textile machines according to a procedure in which, after severing of the yarn section between a full bobbin and a yarn supply device, the yarn which is continuously supplied by that device is removed by means of a suction device and brought into engagement, after insertion of an empty bobbin into a bobbin holder, with a hook-shaped catch element which rotates together with the bobbin.

Apparatus for performing such an operation is provided with a bobbin holder having two bobbin arms between which a bobbin can be held above rotatably mounted bobbin discs, with a yarn supply device associated with the bobbin holder, and with a suction device connected in series with the area of the bobbin discs, and a catch hook is provided at the outer edge of one of the bobbin discs.

In a known winding device for producing cylindrical yarn bodies on textile machines, the yarn which continues to be supplied after removal of the full bobbin is manually introduced into a suction device and during insertion of the empty bobbin and its contact with the slotted drum or cam that drives it, a guide element is moved into an outer end position so as to move the yarn in the direction toward a bobbin arm and thus bring it into engagement with a catch hook which rotates together with the bobbin disc adjacent the guide element.

Upon severing of the yarn in communication with the suction device, and winding of a transitional end piece onto an end region of the bobbin outside of the coiling area, the guide element is returned to its starting position so that the normal winding process can begin.

One drawback possessed by the known winding device is that the guide element, whose axis of rotation lies in the same vertical plane as the bobbin end associated with the catch hook, guides the yarn, during the formation of the reserve loop, exclusively into the region of the catch hook. Consequently, the tie end is wound over several times and is not easily accessible.

Further, a drawback of the procedure effected with the known winding device is that, in time sequence, a reserve winding is formed first and then the bobbin is wound and both windings are formed, once the yarn in communication with the suction device has been severed, exclusively from the yarn coming from the yarn supply device.

Because the cutting process takes place immediately after the catching process, there additionally exists the danger that the yarn which has been severed in the vicinity of the catch hook will not be completely carried along the hook.

SUMMARY OF THE INVENTION

It is therefore an object of the present invention to permit the formation of an easily accessible tie end which nevertheless is held at the bobbin to a sufficient extent.

A further object of the present invention is to accelerate the winding process and reduce yarn losses occurring during the changing of bobbins, thus providing improved economy of operation.

These and other objects of the invention are achieved, in a process of the type described above, by guiding the yarn, after it leaves the yarn supply device, by the suction of the suction device into a direction in which it intersects the plane of rotation of the catch element at the level of the latter, i.e., intersects the path traveled by the yarn intercepting area of the catch element, and immediately after the yarn has been caught by the catch element, transferring the yarn to be wound coming from the yarn supply device to the winding region, and causing the yarn to there be wound. Simultaneously with the transfer of the winding yarn, the reserve yarn removed from the suction device is deflected in a direction toward the bobbin so as to form a reserve winding outside of the winding area, or region.

Thus, the present invention is based on the concept that the yarn, once it has been caught by the catch element, is immediately transferred to the winding region and is there wound while at the same time, outside of the winding region and with the use of the reserve yarn obtained from the suction device, a reserve winding is formed. The simultaneous formation of the bobbin windings and of the reserve winding has the result that the end sections of the yarn loop formed about the catch element are covered by the reserve winding and are thus releasably connected with the bobbin. The advantage obtained by the formation of the reserve winding outside of the winding region is the good accessibility of the reserve winding when the yarn material is processed further.

According to one advantageous embodiment of the process according to the invention, the transfer of the winding yarn and the deflection of the reserve yarn are effected in such a manner that the yarn intersects the plane of rotation of the catch element at the level of the latter for a period of time which is less than the time required for one revolution of the catch element.

The above-described process sequence brings about the result that multiple overwinding of the catch element is prevented and the tie end required for subsequent operating procedures thus remains easily accessible.

According to an advantageous further embodiment of the process according to the invention, the reserve yarn which is in communication with the suction device is severed after formation of the reserve winding and the end of the reserve yarn is releasably bound into the bobbin winding by deflection in the direction toward the bobbin by means of the winding yarn.

The deflection of the reserve yarn is here preferably effected by means of a stream of air. Advisably, the end of the reserve yarn is deflected by utilizing the movement of air present at the outlet end of the suction device.

The apparatus for practicing the method according to the invention is substantially distinguished by the fact that it includes a stationary guide located between the bobbin seating disc and the yarn supply device, the guide having a guide edge at which the yarn length held by the suction device is supported and which is curved so as to produce a deflection of the yarn length which is being carried along in the direction of rotation of the bobbin from the plane of rotation of the catch element in the direction of the bobbin winding region, with the inlet opening of the suction device, which is disposed on the opposite side of the bobbin seating disc from the guide, being disposed in the area of the plane of rotation of the catch element and a yarn guide being provided between the suction device inlet opening and the bobbin seating disc to cooperate with the suction device in guiding the yarn.

In a preferred embodiment of the apparatus, the yarn guide, whose guide edge forms a recess with the suction device inlet opening, is permanently connected with the suction device and can be shifted therewith parallel to the axis of the bobbin.

However, the apparatus may also be advantageously designed so that the yarn guide is constituted by a deflecting roller having a deflecting groove in which the yarn coming from the suction device is guided.

The operation of the apparatus can be improved by providing the periphery of the bobbin seating disc with a steep conical surface and a shallow conical surface carrying the catch element, and by providing the steep conical surface with a yarn guide recess.

In another embodiment of the apparatus the catch element is pivotally fastened in the bobbin seating disc and is shaped so that the plane of its yarn-intercepting opening can be oriented perpendicular to the bobbin axis by the resulting yarn loop.

The bobbin holder is advisably provided with a braking device which brakes the bobbin, after it has been decoupled from the winding drum and is freely slowing down, to a standstill position in which the catch hook will be approximately below the bobbin axis. The operation of the apparatus can here be simplified in that the braking device can be actuated through the arms of the pivotal bobbin holder.

The reserve yarn end is bound into the bobbin winding in a simple manner by the action of a blow nozzle located between the suction device and the bobbin seating disc, which nozzle is connected with the associated bobbin arm.

DESCRIPTION OF THE PREFERRED EMBODIMENTS

Figure 1:
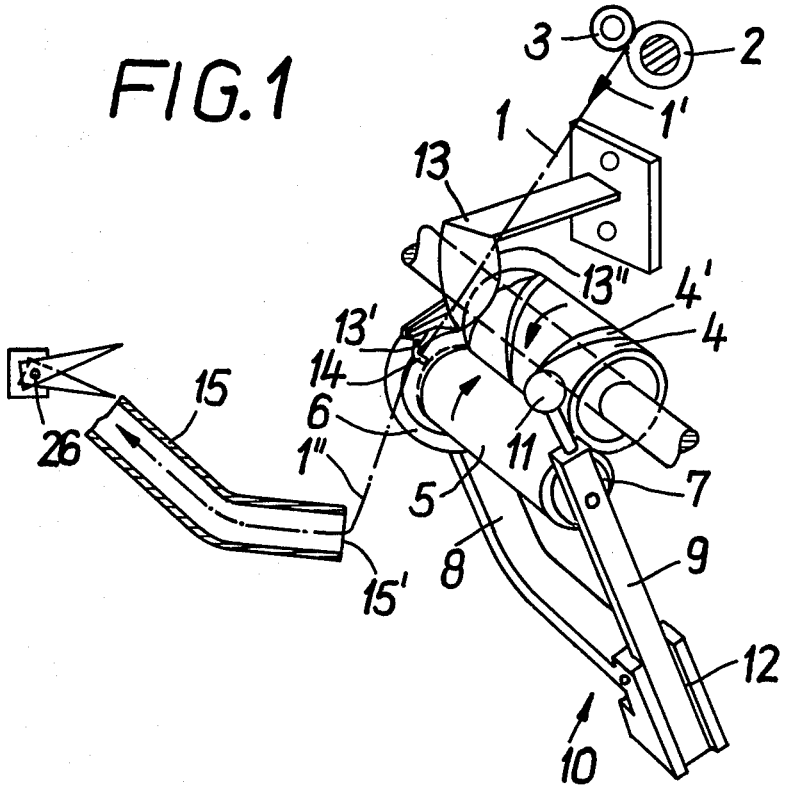
FIG. 1 is a perspective view of a winding device in a spinning and spooling machine, with a suction device according to the invention.

In the apparatus shown in FIG. 1, the yarn 1 coming from a textile machine (not shown), for example an open-end spinning unit, is fed, by means of a yarn supply device 2,3 including a delivery roller 2 and a pressure roller 3, and with the aid of a grooved winding drum 4, to a bobbin 5 and is wound onto the latter. By guiding the yarn in grooves 4', of drum 4 during rotation of the drum, there is produced, for example, a criss-cross winding. The winding drum 4 is rotated counterclockwise by a suitable drive, which is not shown.

Bobbin 5 is clamped in between two bobbin discs 6 and 7 which are each rotatably mounted in two bobbin arms 8 and 9 of a bobbin holder 10. The latter is mounted to be pivotal about a stationary horizontal axis (not shown).

Release of the full bobbin 5 is achieved by effecting outward pivotal movement of bobbin arm 9 away from the bobbin, by acting on an operating lever 11 connected to arm 9, the arm being supported in a guide 12 of bobbin holder 10.

A metal guide 13 is connected ahead of the bobbin 5 when seen in the direction of movement 1' of yarn 1. Guide 13 is stationary and is held, for example, in the machine frame (not shown). Bobbin disc 6, which is a bobbin seating disc and is provided with a hook-shaped element 14, has associated with it a suction device 15 whose entrance opening 15' lies in the area of the plane of rotation of catch element 14.

Guide 13 has a horizontally disposed guide edge 13' and a vertically disposed guide edge 13''. When seen in the direction of rotation of bobbin 5, both guide edges are curved from the outside toward the bobbin.

Figure 6A:
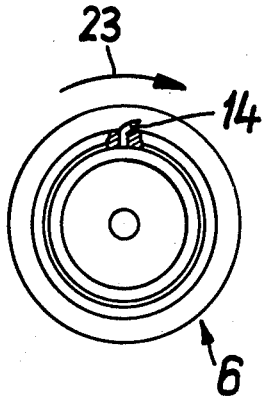
FIGS. 6*a* and 6*b* are an end view and a partial cross-sectional view, respectively, of the bobbin seating disc of FIG. 5.
Figure 6B:
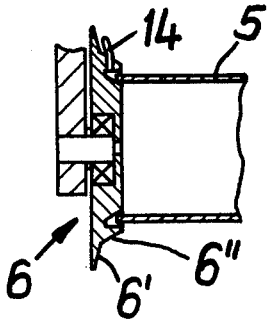
Figure 7A:
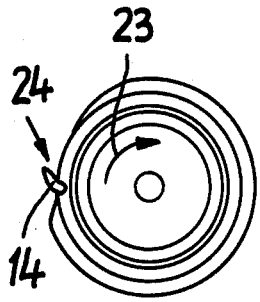
FIGS. 7*a* and 7*b* are a side and front view, respectively, of an embodiment of a bobbin seating disc provided with a yarn guide recess.
Figure 7B:
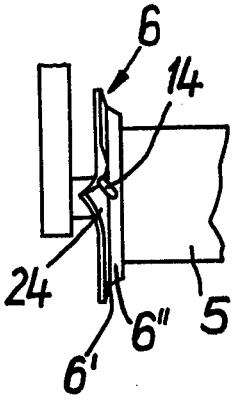

Guide edge 13' serves to support the length of yarn 1'', which is in communication with the suction device 15, and by that to put it in exact position in order to enable the catch hook 14 to surely catch the yarn is. The yarn deflected away from the plane of rotation of catch hook 14, once the latter has caught the yarn, and in a direction toward the bobbin by a shallow conical surface 6'' or by a steep conical surface 6' and a shallow conical surface 6'' shown in FIGS. 6*b* and 7*b*. By means of guide edge 13'', the winding yarn coming from the yarn supply device 2, 3 is transferred, during rotation of the bobbin, into the region of the winding drum 4 and is applied with the aid of the latter onto the winding area of bobbin 5.

The operation of the apparatus according to the invention will be explained with reference to FIGS. 2 and 3, as well as FIG. 1. FIG. 3 shows a later stage in the winding operation than does FIG. 2.

Once a bobbin has been completely wound and the yarn has been severed, the yarn 1 which continues to be supplied by device 2, 3 is sucked in by suction device 15 and brought to a yarn reservoir (not shown). Upon insertion of an empty bobbin into bobbin holder 10 and bringing the empty bobbin into contact with winding drum 4, the entrance region 15' of the suction device is shifted into a position in which the length of yarn which is disposed between the yarn supply device 2, 3 and a yarn guide 16 fastened to the entrance region 15', as seen in FIGS. 2 and 3, is deflected under the influence of the yarn guide into a direction in which it intersects the path of rotation of catch hook 14, i.e., intersects the plane of hook rotation at the diameter defining the location of the hook itself. Yarn guide 16 is provided with a guide edge 16' which forms a recess with entrance section 15' to guide the yarn.

Upon rotation of the empty bobbin, the above-mentioned length of yarn is carried along in the direction of bobbin movement so that the reserve yarn 1'' is deflected, by means of the conical surfaces 6' and 6'', away from the region of the plane of rotation of catch hook 14 and the winding yarn coming from the yarn supply device is transferred into the winding area, by means of the guide edges 13' and 13''.

Consequently, a yarn loop 17 forms about catch hook 14 and the end of bobbin 5 adjacent hook 14 is covered by the reserve yarn removed from suction device 15, which forms the reserve winding 18 outside the winding area of bobbin 5, as shown in FIG. 3. The length of the reserve yarn is limited to the required amount by actuation of a cutting device 26.

The winding yarn which continues to be furnished by the yarn supply device forms windings 19 on the bobbin in the range of operation of winding drum 4. Thus immediately after the catching process, yarn 1 is guided away from the area of the plane of rotation of catch hook 14 so that multiple overwinding of the catch hook is made impossible because the catching process takes place but once.

Below bobbin seating disc 6, there is disposed a blow nozzle 20, shown in FIGS. 2 and 3, which acts to deflect the free end of the reserve yarn, as it is withdrawn from suction device 15, in an axial direction toward bobbin 5, so that the yarn end becomes bound into the bobbin windings 19 being formed by the winding operation. The blowing air can be derived from the stream of air coming from suction device 15.

Figure 4:
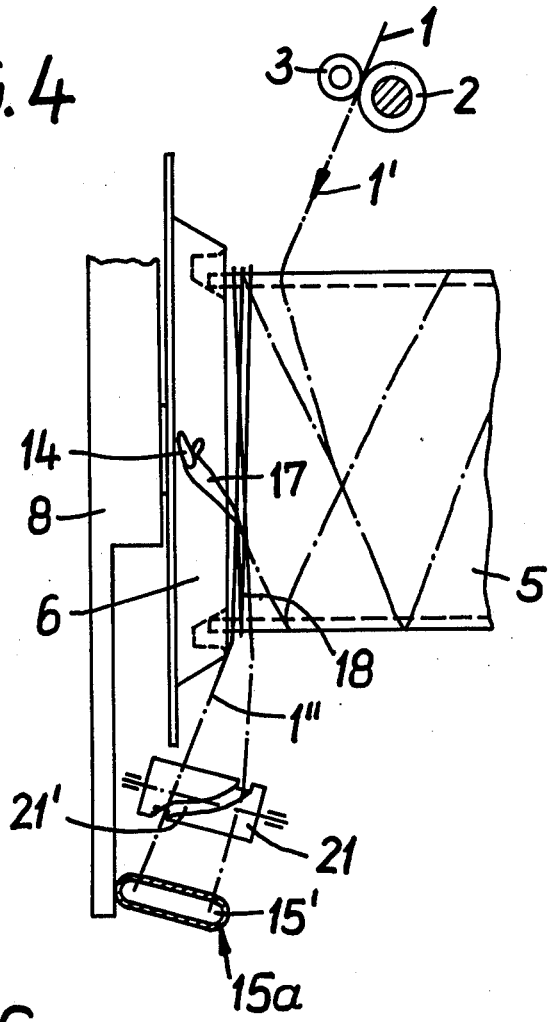
FIG. 4 is a view similar to that of FIG. 3 of a modified winding device with an additional changing roller.

The above-described embodiment may be modified, as shown in FIG. 4, by the inclusion of a changing roller 21 with a guide groove 21' between bobbin seating disc 6 and the entrance section 15' of suction device **15*a***.

The reserve yarn 1'' extracted from suction device **15*a* to form the reserve winding 18 is moved back and forth in guide groove 21' so that a back-and-forth covering of the end sections of loop 17 takes place. The entrance section 15' of suction device 15** is then advantageously given an oval shape.

Referring again to FIGS. 2 and 3, bobbin arm 8 serves to determine the position of suction device 15 and yarn guide 16, or of suction device **15*a* and changing roller 21 of FIG. 4, respectively, with respect to bobbin seating disc 6**.

Figure 5:
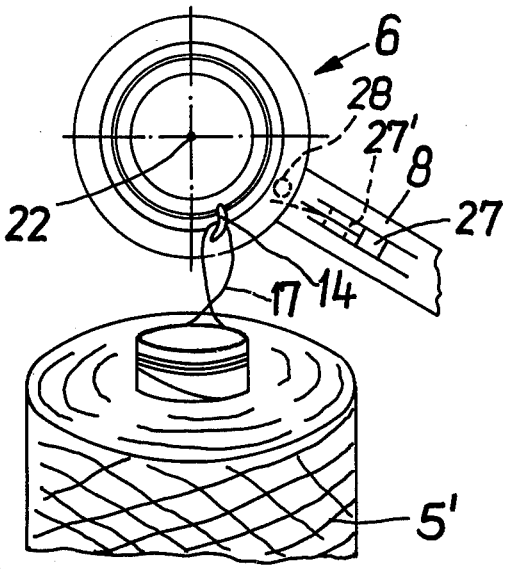
FIG. 5 is a perspective detail view of a portion of the arrangement of FIG. 1 showing the bobbin seating disc with a bobbin which has been released from the bobbin holder.

Referring now to FIG. 5, after having been wound, the full bobbin 5' is ejected from bobbin holder 10 at an instant when the hook-shaped catch element 14 is positioned below the axis of rotation 22 of the bobbin discs. Loop 17 can thus release itself automatically from catch element 14 so that destruction of the tie end is made possible.

The bobbin seating disc 6 can be brought to the ejection position shown in FIG. 5 by stopping bobbin 5', which is slowing down under the influence of its own inertia, by means of a braking device (not shown). Advisably, the braking device is actuated by operation of lever 11.

According to a preferred embodiment of the present invention, operating lever 11 is connected, via a lever mechanism (not shown), with a slide member 27 carrying a leaf spring which is displaceably held in bobbin arm 8. By depressing lever 11, the slide member is shifted in the direction toward bobbin disc 6, to position 27, so that the spring is brought into engagement with a cam 28 which is fastened to the side of bobbin disc 6 facing away from the bobbin. This interaction between parts 27 and 28 causes the bobbin disc to be intermittently braked and finally brought to a standstill in the position shown in FIG. 5.

Figure 2:
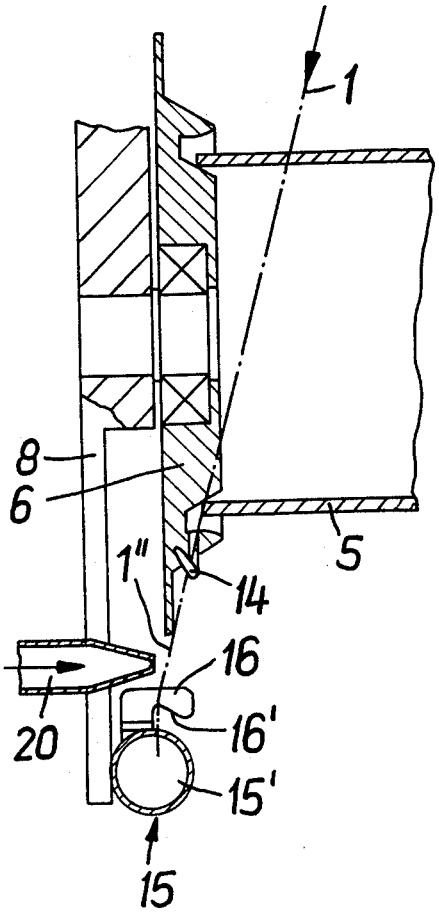
FIG. 2 is a partial cross-sectional view through the winding device of FIG. 1 in the area of the bobbin seating disc during the catching process.
Figure 3:
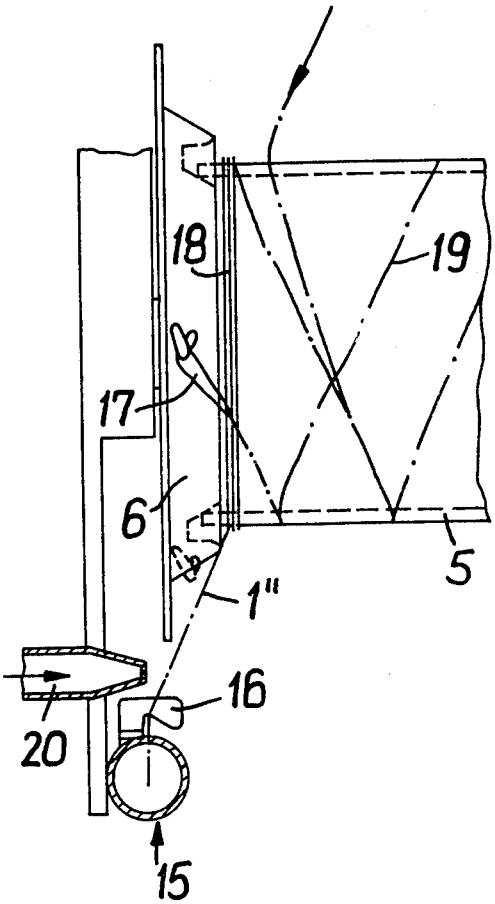
FIG. 3 is an elevational view of the same portion as FIG. 2, after the yarn loop has been formed.

In order to improve yarn guidance after the catching process, according to a modification of the embodiment of FIGS. 2 and 3, the periphery of the bobbin seating disc 6 is provided, as shown in FIGS. **6*a* and 6*b*, with a steep conical surface 6' and a shallow conical surface 6'', with the catch hook 14 being disposed in the shallow conical surface. The end section of hook 14 points in the direction of movement 23 of the bobbin seating disc 6 and is bent toward the outside, i.e., away from bobbin 5**.

Figure 8A:
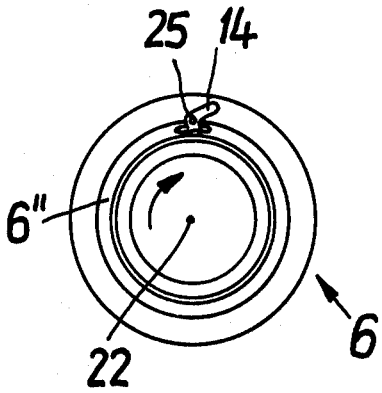
FIGS. 8*a* and 8*b* are side views of two operating states of an embodiment of a bobbin seating disc with rotatably mounted catch element.
Figure 8B:
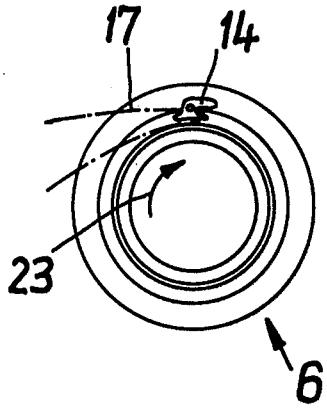

In order to get best results in catching of the length of yarn presently between yarn supply device 2, 3 and suction device 15, bobbin seating disc 6 may, as shown in FIGS. **7*a* and 7*b*, be provided at its periphery with a yarn guide recess 24. The outer periphery of the bobbin seating disc 6 is then bent away from the bobbin 5 in the region behind the catch hook, with respect to the direction of rotation 23, and exerts an additional deflecting influence on the yarn to be caught in the direction toward the catch hook. The catching process is moreover enhanced by setting the steep conical surface in front of the catch hook back approximately to the outer diameter of the shallow conical surface. In FIGS. 8*a* and 8*b* is illustrated a further possibility for getting best results in catching of the yarn and for preventing single or multiple winding of the yarn round the bobbin seating disc 6 at the side of the catch element which is directed away from the bobbin 5, which involves fastening catch hook 14 to bobbin seating disc 6 by means of a pivot pin 25 so that hook 14 is pivotable about the pivot axis of pin 25, which axis is parallel to the bobbin rotation axis 22. The foot of the catch hook then engages in a groove in the shallow conical surface 6'' below pivot axis 25. After the catching process, the loop of yarn 17 is supported at the foot of catch hook 14 and upon rotation of the bobbin seating disc 6, the yarn loop lowers the initially upwardly directed catch hook by pivoting it in the direction of arrow 23. Hook 14 normally tends to assume the raised position shown in FIG. 8*a* under the influence of the centrifugal forces generated by the rotation of bobbin 5 and discs 6 and 7. If needed, a weak spring could be attached to the foot of hook 14** to bring it to the raised position when not engaging a yarn loop.

It will be understood that the above description of the present invention is susceptible to various modifications, changes and adaptations, and the same are intended to be comprehended within the meaning and range of equivalents of the appended claims.

What is claimed is:

1. In a method for forming a tie on reserve winding on a bobbin which defines a yarn winding region and which is supported in a bobbin holder in a textile machine having a yarn supply device for supplying yarn to the bobbin during a winding operation in which, after severing of the yarn between a full bobbin and the yarn supply device, the yarn which continues to be supplied by the yarn supply device is drawn off by means of a suction device and, after replacement of the full bobbin by an empty bobbin in the bobbin holder, the yarn is brought into engagement with a hook-shaped catch element which is located between the yarn supply and suction device and which rotates together with the bobbin, said method comprising: moving the inlet end of the suction device, together with the yarn portion entering the suction device, in a direction parallel to the axis of the bobbin for causing the yarn, after it leaves the yarn supply device, to be directed by the suction action of the suction device in a direction such that it intersects the plane of rotation of the catch element at the diameter at which the catch element is located; immediately after the catch element has caught the yarn transferring the winding yarn coming from the yarn supply device into the winding region and causing the yarn to be wound there; and, simultaneously with said transferring of the winding yarn extracting the yarn located downstream of the catch element from the suction device and deflecting that yarn in a direction toward the bobbin so as to form a reserve winding on the bobbin adjacent, and axially spaced from, the winding region.

2. A method as defined in claim 1 wherein said steps of transferring and deflecting are carried out in a manner to cause the yarn to intersect the path of rotation of the catch element only for a period of time which is less than the time required for one revolution of the catch element.

3. A method as defined in claim 1 wherein said step of deflecting includes causing the end of the length of yarn forming the reserve winding to be releasably bound into the windings on the bobbin winding region.

4. A method as defined in claim 3 wherein said step of deflecting includes applying a stream of air to the yarn forming the reserve winding.

5. In a textile apparatus including a bobbin holder composed of two bobbin arms and two rotatable bobbin discs, each carried by a respective arm, one of the bobbin discs being a bobbin seating disc and the bobbin holder being arranged to hold a bobbin between the discs, a yarn supply device disposed for feeding yarn to the bobbin holder, a suction device located on the opposite side of the bobbin discs from the yarn supply device, and a hook-shaped catch element mounted at the periphery of one of the bobbin discs, the improvement comprising: stationary metal guide located to the side of said bobbin seating disc which is directed toward said yarn supply device, said guide being provided with a first guide edge which supports the length of yarn in communication with said suction device and a second guide edge which is curved in such a manner that the length of the yarn between said yarn supply device and said catch element which is carried along in the direction of rotation of said bobbin is deflected from the plane of rotation of said catch element in the direction of said bobbin; and a yarn guide positioned to guide yarn into said suction device; and wherein the inlet opening of said suction device is located in the area of the plane of rotation of said catch element and said yarn guide is located between said suction device inlet opening and said bobbin seating disc.

6. An arrangement as defined in claim 5 wherein said yarn guide is provided with a guide edge which forms a recess with the inlet end of said suction device and said yarn guide is permanently connected to said suction device to permit said yarn guide to be shifted together with said suction device in a direction parallel to the axis of bobbin rotation.

7. An arrangement as defined in claim 5 wherein said yarn guide is constituted by a deflection roller having a yarn deflection groove arranged to guide the yarn as it is withdrawn from said suction device.

8. An arrangement as defined in claim 5 wherein the periphery of said bobbin seating disc is provided with a steep conical surface and a shallow conical surface interposed between said steep surface and said bobbin, said catch element is mounted in the region of said shallow surface, and said steep conical surface is being provided with a yarn guide recess.

9. An arrangement as defined in claim 5 wherein said catch element presents a yarn intercepting opening lying in a plane and is pivotally mounted in said bobbin seating disc and is formed to permit the plane of its yarn intercepting opening to be oriented perpendicular to the axxis of bobbin rotation by the force exerted by the yarn on said catch element.

10. An arrangement as defined in claim 5 wherein said bobbin holder further includes a braking device for braking a bobbin after it has been decoupled from its drive and is freely slowing down, to a standstill in a position in which said catch element is disposed approximately below the axis of bobbin rotation.

11. An arrangement as defined in claim 10 wherein said bobbin holder is pivotally mounted and said braking device is connected to be actuated via one of said bobbin arms.

12. An arrangement as defined in claim 5 further comprising a blow nozzle connected with one of said bobbin arms and located between said suction device and said bobbin seating disc for producing a stream of air which deflects the end of the length of yarn in communication with said suction device in an axial direction toward the region between said bobbin discs.

* * * * *